US005529715A

United States Patent [19]

Kuroda et al.

[11] Patent Number: 5,529,715

[45] Date of Patent: Jun. 25, 1996

[54] NONIONIC POWDERY DETERGENT COMPOSITION AND PROCESS FOR PRODUCING THE SAME

[75] Inventors: Mutsumi Kuroda; Hiroyuki Yamashita, both of Wakayama; Shinichi Yabe, Tochigi; Yoshinori Otani, Wakayama, all of Japan

[73] Assignee: Kao Corporation, Tokyo, Japan

[21] Appl. No.: 311,446

[22] Filed: Sep. 26, 1994

Related U.S. Application Data

[63] Continuation of Ser. No. 30,719, Mar. 12, 1993, abandoned.

[30] Foreign Application Priority Data

Mar. 27, 1992 [JP] Japan ..... 4-071208

[51] Int. Cl.[6] ..... C11D 3/06; C11D 3/08

[52] U.S. Cl. ..... 252/135; 256/174.21; 256/174.14; 256/174.25; 256/DIG. 1

[58] Field of Search ..... 252/174.25, 174.21, 252/174.14, 135, DIG. 1

[56] References Cited

U.S. PATENT DOCUMENTS

| | | | |
|---|---|---|---|
| 4,136,051 | 1/1979 | Saran et al. | 252/91 |
| 4,260,651 | 4/1981 | Wixon | 427/214 |
| 4,347,152 | 8/1982 | Wixon | 252/91 |
| 4,406,808 | 9/1983 | Gangwisch et al. | 252/91 |
| 4,457,854 | 7/1984 | Gangwisch et al. | 252/91 |
| 4,646,817 | 5/1987 | Wixon et al. | 252/8.8 |
| 4,666,738 | 5/1987 | Wixon et al. | 427/214 |
| 4,869,843 | 9/1989 | Saito et al. | 252/135 |
| 4,988,454 | 1/1991 | Eeclink et al. | 252/140 |
| 5,024,778 | 6/1991 | Grecsek | 252/140 |
| 5,080,820 | 1/1992 | Grecsek | 252/140 |
| 5,151,200 | 9/1992 | Huijben et al. | 252/174.14 |
| 5,205,958 | 4/1993 | Swarling et al. | 252/174.3 |

FOREIGN PATENT DOCUMENTS

| | | |
|---|---|---|
| 77974A2 | 1/1992 | European Pat. Off. . |
| 13824A2 | 11/1992 | European Pat. Off. . |
| 2500475 | 8/1982 | France . |
| 58-204098 | 11/1983 | Japan . |
| 61-89300 | 5/1986 | Japan . |
| 2263229 | 11/1987 | Japan . |
| 4363400 | 12/1992 | Japan . |
| 1474858 | 5/1977 | United Kingdom . |

*Primary Examiner*—Paul Lieberman
*Assistant Examiner*—Kery A. Fries
*Attorney, Agent, or Firm*—Birch, Stewart, Kolasch & Birch

[57] ABSTRACT

A nonionic powdery detergent composition which does not cause any deterioration in the solubility even after storage for a long period of time, comprising (a) 12 to 35% by weight of a nonionic surfactant having specified properties, (b) 5 to 60% by weight of a water-soluble chelating agent, (c) 5 to 20% by weight of an oil-absorbent carrier having specified properties and (d) 2 to 40% by weight of an alkali metal carbonate, and having a water-soluble alkali metal silicate content of less than 5% by weight.

This nonionic powdery detergent composition is produced by adding the nonionic surfactant (a) to a mixture comprising the components (b), (c) and (d).

18 Claims, No Drawings

NONIONIC POWDERY DETERGENT COMPOSITION AND PROCESS FOR PRODUCING THE SAME

This application is a continuation, of application Ser. No. 08/030,719 filed on Mar. 12, 1993, now abandoned.

BACKGROUND OF THE INVENTION

1. Field of the Invention

The present invention relates to a powdery detergent composition comprising a nonionic surfactant as a main base and a process for producing the same, and more particularly to a powdery detergent composition which does not cause any deterioration with respect to its solubility during storage, and a process for producing the same.

2. Description of the Related Art

A nonionic surfactant has various features such as good hard water resistance and, at the same time, prominent detergency and capability of dispersing soil, and further very excellent biodegradability, so that it is deemed to be an important surfactant for washing.

However, since many nonionic surfactants used for washing purposes are usually liquid at ordinary temperatures, they have the problem that when they are incorporated in a liquid state in a powdery detergent composition in a large amount, they gradually bleed out with the lapse of time and penetrate into the inside of the paper container which holds the detergent composition, which remarkably deteriorates the fluidity of the powdery detergent composition or brings about caking to render the detergent composition massive, which remarkably deteriorates the commercial value of the detergent composition. These problems have led to various studies.

U.S. Pat. No. 4136051 (published on Jan. 23, 1979, Assignee: Henkel KGaA) discloses a detergent composition having an improved fluidity and comprising a premixture composed of a crystalline or amorphous aluminosilicate having an ion exchange capacity of 50 mg CaO/g (89 mg $CaCO_3$/g) or more (4% or less of a highly dispersive silica may be used as an oil absorbent carrier), a nonionic surfactant and optionally an inorganic peroxide capable of forming hydrogen peroxide in water and, incorporated into the premixture, a spray-dried detergent composition. Great Britain Patent No. 1474856 discloses a detergent composition having an improved fluidity and comprising a mixture of a synthetic amorphous silica derivative (including an aluminosilicate) having an oil absorbability of 50 to 200 $cm^3$/100 g with a nonionic surfactant and a phosphoric chelating agent. Further, Japanese Patent Laid-Open No. 89300/1986 discloses a process for producing a granulated detergent composition having excellent powder properties and produced by mixing a water-soluble powder with a silica powder, spraying the mixture with a nonionic surfactant and adding a zeolite or calcium carbonate powder thereto. Furthermore, U.S. Pat. Nos. 5,080,820 and 5,024,778 disclose a nonionic powdery detergent composition containing spray-dried beads comprising an aluminosilicate and bentonite and having a water-soluble silicate content of 5% by weight or less.

As described above, it is known that the incorporation of a siliceous substance or a clayey substance, such as bentonire, into a detergent composition containing a nonionic surfactant contributes to an improvement in the powder properties of the detergent composition, such as fluidity.

In fact, the use of the siliceous substance or the clayey substance as an oil-absorbent carrier serves to prevent the nonionic surfactant from bleeding. However, there is a tendency that the solubility of the detergent composition lowers during storage for a long period of time under high-humidity conditions and, in addition, when the detergent composition contains a water-soluble alkali metal silicate such as water glass, the solubility of the detergent composition remarkably lowers.

This requires a further improvement in the solubility after the lapse of time of a powdery detergent composition containing a nonionic surfactant.

SUMMARY OF THE INVENTION

Under the above-described circumstances, the present inventors have made extensive studies on a powdery detergent composition comprising a nonionic surfactant as a main base for the detergent and, as a result, have found that the incorporation of a nonionic surfactant having a melting point of 40° C. or below, a water-soluble chelating agent, an oil-absorbent carrier having specified properties and an alkali metal carbonate and a reduction in the content of a water-soluble alkali metal silicate can provide a nonionic powdery detergent composition which does not cause any deterioration with respect to its solubility even after storage, which has led to the completion of the present invention.

Accordingly, the present invention provides a nonionic powdery detergent composition having a water-soluble alkali metal silicate content of less than 5% by weight based on the total weight of the composition, which comprises (a) 12 to 35% by weight based on the total weight of the composition of a nonionic surfactant having a melting point of 40° C. or below; (b) 5 to 60% by weight based on the total weight of the composition of a water-soluble chelating agent; (c) 5 to 20% by weight based on the total weight of the composition of an oil-absorbent carrier containing silicon in an amount of 30% by weight or more of $SiO_2$ as determined with no hydrate present, said oil-absorbent carrier having an oil absorbability of 80 ml/100 g or more, and wherein said oil-absorbent carrier as a 5% by weight dispersion has a pH value of 9 or greater; or wherein the amount of dissolution of said oil-absorbent carrier in 100 ml of a 2% by weight aqueous NaOH solution is 0.5 g or less; and (d) 2 to 40% by weight based on the total weight of the composition of an alkali metal carbonate, and a process for producing the same.

The present invention further provides a nonionic powdery detergent composition having a water-soluble alkali metal silicate content of less than 5% by weight based on the total weight of the composition, which comprises (a) 12 to 35% by weight based on the total weight of the composition of a nonionic surfactant having a melting point of 40° C. or below; (b) 5 to 60% by weight based on the total weight of the composition of a water-soluble chelating agent; (c) 5 to 20% by weight based on the total weight of the composition of an oil-absorbent carrier containing silicon in an amount of 30% by weight or more of $SiO_2$ as determined with no hydrate present, said oil-absorbent carrier having an oil absorbability of 80 ml/100 g or more, and wherein said oil-absorbent carrier as a 5 % by weight dispersion has a pH value of 9 or greater; or wherein the amount of dissolution of said oil-absorbent carrier in 100 ml of a 2% by weight aqueous NaOH solution is 0.5 g or less; (d) 2 to 40% by weight based on the total weight of the composition of an alkali metal carbonate, and (e) 1 to 5% by weight based on the total weight of the composition of a polyethylene glycol having a weight average molecular weight of 4,000 to 20,000, and a process for producing the same.

In general, the above-described nonionic powdery detergent compositions according to the present invention do not contain a crystalline layer silicate represented by the following general formula (X):

$$M_2Si_xO_{(2x+1)}\cdot y(H_2O) \quad (X)$$

wherein

M represents an alkali metal atom and x and y are respectively $1.5 \leqq x \leqq 4$ and $y \leqq 25$, that is $0 < y \leqq 25$.

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The nonionic surfactant (a) to be used in the present invention is a liquid or a slurry at a temperature of 40° C., that is, the nonionic surfactant (a) has a melting point of 40° C. or below. The nonionic surfactant (a) exhibits excellent soil removal, foaming and foam breaking.

Specific examples of the nonionic surfactant (a) include a polyoxyethylene alkyl ether, a polyoxyethylene alkylphenyl ether, a polyoxyethylene sorbitan/fatty acid ester, a polyoxyethylene sorbitol/fatty acid ester, a polyethylene glycol/fatty acid ester, a polyoxyethylene polyoxypropylene alkyl ether, a polyoxyethylene castor oil, a polyoxyethylene hydrogenated castor oil, a polyoxyethylene alkylamine, a glycerin/fatty acid ester, a higher fatty acid alkanolamide, an alkylglycoside and an alkylamine oxide.

Among them, a polyoxyethylene alkyl ether produced by adding ethylene oxide to a straight-chain or branched, primary or secondary alcohol having 10 to 20 carbon atoms (on the average), preferably 10 to 15 carbon atoms (on the average), particularly preferably 12 to 14 carbon atoms (on the average) in such a manner that the average number of moles of addition of ethylene oxide is 5 to 15, preferably 6 to 12, still preferably 6 to 10 is preferably used as a main nonionic surfactant.

In general, the polyoxyethylene alkyl ether contains a large amount of an adduct of an alkyl ether with ethylene oxide wherein the number of moles of addition of ethylene oxide is small. It is preferred to use a polyoxyethylene alkyl ether wherein the content of an adduct having the number of moles of addition of ethylene oxide of 0 to 3 is 35% by weight or less, preferably 25% by weight or less.

The nonionic powdery detergent composition according to the present invention contains the nonionic surfactant (a) in an amount of 12 to 35% by weight, preferably 15 to 30% by weight based on the total weight of the composition.

A water-soluble chelating agent (b) may be at least one member selected from among, for example, a pyrophosphate, a hexametaphosphate and a tripolyphosphate and further tartaric acid, citric acid, oxydiacetic acid, oxydisuccinic acid, 1,2,3,4-cyclopentanetetracarboxylic acid, tartrate monosuccinate, tartratedisuccinate and their salts. Among them, pyrophosphates and tripolyphosphates and further citric acid and its salts are particularly preferred.

The nonionic powdery detergent composition according to the present invention contains the water-soluble chelating agent (b) in an amount of 5 to 60% by weight, and preferably 15 to 50% by weight, based on the total weight of the composition.

The oil-absorbent carrier (c) includes, for example, an amorphous silica and an amorphous aluminosilicate which contain silicon in an amount of 30% by weight or more of $SiO_2$, preferably 40% by weight or more of $SiO_2$, and still preferably 70% by weight or more of $SiO_2$ as determined with no hydrate present, have an oil absorbability (testing method: JIS K 6220) of 80 ml/100 g or more, preferably 150 ml/100 g or more, still preferably 200 ml/100 g or more and most preferably 200 to 800 ml/100 g, and satisfy a requirement that a 5% by weight dispersion thereof has a pH value of 9 or greater (testing method: JIS K 6220). The content of silicon in the oil-absorbent carrier (c) is represented by a value calculated as $SiO_2$.

An amorphous silica and an amorphous aluminosilicate each having a mean particle diameter up to 200 μm are commercially available. In the present invention, the oil-absorbent carrier (c) may be selected from these commercially available carriers. Examples of the above-described oil-absorbent amorphous silica include Tokusil AL-1 (manufactured by Tokuyama Soda Co., Ltd.), Nipsil NA (manufactured by Nippon Silica Industrial Co., Ltd.), Carplex #100 (manufactured by Shionogi & Pharmaceutical Co., Ltd.), and Sipernat D10 (DEGUSSA). Examples of the oil-absorbent amorphous aluminosilicate include an oil-absorbent carrier commercially available under the trade name of Tixolex 25 (manufactured by Kofran Chemical Co., Ltd.).

The above-described commercially available oil-absorbent carriers have scarcely any cation exchange capacity. An oil-absorbent carrier having an ion exchange capacity is advantageous because it serves also as a builder for a detergent. Examples of the oil-absorbent carrier having a high oil absorbability and a high cation exchange capacity include oil-absorbent amorphous aluminosilicates represented by the following general formula (1)

$$a(M_2O).Al_2O_3.b(SiO_2).c(H_2) \quad (1)$$

wherein

M represents an alkali metal atom and a, b and c each represent the number of moles of the respective component, wherein generally $0.7 \leqq a \leqq 2.0$, $0.8 \leqq b \leqq 4$ and c represents an arbitrary positive number.

Oil-absorbent amorphous aluminosilicates represented by the following general formula (2) are particularly preferred:

$$Na_2O.Al_2O_3.m(SiO_2).c(H_2O) \quad (2)$$

wherein m is 1.8 to 3.2 and c is 1 to 6.

The above-described amorphous aluminosilicate having high oil absorbability and high ion exchange capacity which may be used in the present invention may be produced as follows advantageously.

An alkalescent aqueous solution of an alkali metal aluminate having a molar ratio of $M_2O$ (wherein M represents an alkali metal atom) to $Al_2O_3$ of 1.0 to 2.0 and a molar ratio of $H_2O$ to $M_2O$ of 6.0 to 500 is added at a temperature of 15° to 60° C., preferably 30° to 50° C., under vigorous stirring to an aqueous solution of an alkali metal silicate having a molar ratio of $SiO_2$ to $M_2O$ of 1.0 to 4.0 and a molar ratio of $H_2O$ to $M_2O$ of 12 to 200. Alternatively, the aqueous solution of an alkali metal silicate may be added to the alkalescent aqueous solution of an alkali metal aluminate. Then, the formed white precipitate slurry is heat-treated at a temperature of 70° to 100° C., preferably 90° to 100° C. for 10 min to 10 hr, preferably 5 hr or less, and then filtered. The precipitate on the filter was washed and dried to provide a product. According to the above-described method, an amorphous aluminosilicate oil-absorbent carrier having an ion exchange capacity of 100 $CaCO_3$ mg/g or more and an oil absorbability of 200 ml/100 g or more can be easily produced.

When an oil-absorbent carrier, of which 5% by weight dispersion has a pH value of less than 9.0, and which contains silicon in an amount of 30% by weight or more of $SiO_2$ and particularly 70% by weight or more of $SiO_2$ as determined with no hydrate present and has an oil absorbability of 80 ml/100 g or more, is incorporated into a detergent composition, the solubility of the detergent composition deteriorates particularly when the detergent composition is stored under high-humidity conditions.

The pH value of the dispersion containing 5% by weight of the oil-absorbent carrier is measured according to JIS K 6220. Namely, about 5 g of a sample is weighed into a hard conical flask, and 100 ml of water free from carbonic acid (carbon dioxide) is added thereto. The conical flask is stoppered and then is shaken for 5 min. After shaking, a pH value of the resultant dispersion is measured according to the glass electrode method (see 7.2.3 of JIS Z 8802).

A nonionic powdery detergent composition which does not cause any deterioration of its solubility during storage can be produced, when an oil-absorbent carrier having a pH value of the 5% by weight dispersion of 9.0 or greater, containing silicon in an amount of 30% by weight or more of $SiO_2$ as determined with no hydrate present and having an oil absorbability of 80 ml/100 g or more is selected.

In some oil-absorbent carriers, although the pH value of a 5% dispersion thereof is below 9.0, the amount of dissolution in 100 ml of a 2% aqueous NaOH solution is 0.5 g or less. The oil-absorbent carriers of this type as well fall within the scope of the present invention. For example, "Perlite 4159" manufactured by Dicalite Orient Co., Ltd. exhibits the above-described properties and can be used as the oil-absorbent carrier (c) in the present invention.

Specifically, the above-described oil-absorbent carrier is one wherein the amount of dissolution of the oil-absorbent carrier is 0.5 g or less as measured according to a method which comprises dispersing 10 g of the oil-absorbent carrier in 100 ml of a 2% aqueous NaOH solution, stirring the dispersion at a constant temperature of 25° C. for 16 hr and determining the $SiO_2$ content of the filtrate by colorimetry (Regarding the colorimetry, reference may be made to "Yukagaku", vol. 25, p. 156, 1976).

When the alkalinity of the detergent composition is very high, that is, the aqueous solution of the detergent composition exhibits a high pH value, or the detergent composition is stored under very severe conditions, it is preferred to select an oil-absorbent carrier capable of satisfying a more strict requirement that the pH value of the 5% by weight dispersion thereof is 9.0 or greater and the amount of dissolution in 100ml of a 2% aqueous NaOH solution is 0.5 g or less. Examples of the oil-absorbent carrier which can satisfy the above-described more strict requirement include "Na-Mordenite HSZ-640 NAA" manufactured by Tosoh Corporation and can be found also in amorphous aluminosilicates represented by the formula (2) described above.

The nonionic powdery detergent composition according to the present invention contains the oil-absorbent carrier (c) in an amount of 5 to 20% by weight, and preferably 5 to 10% by weight, based on the total weight of the composition.

The alkali metal carbonate (d) according to the present invention is soluble in water. The alkali metal carbonate (d) may be a carbonate of sodium or potassium or a mixture of the sodium salt with the potassium salt. Among them, sodium carbonate is preferred in the present invention. Examples of the sodium carbonate include heavy sodium carbonate (heavy ash) and light sodium carbonate (light ash). The average particle diameter of the alkali metal carbonate (d) is 10 to 2000 μm, preferably 100 to 1000 μm.

The nonionic powdery detergent composition according to the present invention contains the alkali metal carbonate (d) in an amount of 2 to 40% by weight, preferably 5 to 35% by weight, and still preferably 5 to 25% by weight, based on the total weight of the composition.

An alkali metal silicate is one having a $SiO_2/M_2O$ (wherein M represents an alkali metal atom, e.g., sodium and/or potassium) ratio of from 0.5 to 4.0, and is generally incorporated into a detergent composition as an water soluble alkaline salt or used as a corrosion inhibitor for a metal.

In the nonionic powdery detergent composition of the present invention, the content of the water-soluble alkali metal silicate is less than 5% by weight, and preferably 1% by weight or less. When the content of the water-soluble alkali metal silicate is 5% by weight or more, the solubility of the detergent composition is liable to be remarkably lower.

When the nonionic powdery detergent composition of the present invention also contains a polyethylene glycol (e) having a weight average molecular weight of 4000 to 20000 in an amount of 1 to 5% by weight, and preferably 1 to 3% by weight, based on the total weight of the composition, the properties of the powdery detergent composition as a powder during storage for a long period of time can be further improved. As will be described later, in the production of the powdery detergent composition containing the polyethylene glycol (e) according to the present invention, it is preferred to add the above-described polyethylene glycol (e) to a mixture comprising the water-soluble chelating agent (b), the oil-absorbent carrier (c) and the alkaline metal carbonate (d) as powdery components.

Besides the above-described components, the powdery detergent composition of the present invention usually contains detergent assistants and additives. Specific examples thereof include inorganic electrolytes such as sodium sulfate, antiredeposition agents such as an aminopolyacetate, a polyacrylate and carboxymethylcellulose, enzymes such as protease, lipase, cellulase and amylase, antioxidants, fluorescent dyes, blueing agents and perfumes. Further, it is also possible to utilize, as a detergent assistant, bleaching agents such as sodium percarbonate and sodium perborate mono- or tetrahydrate, stabilizers for a peroxide such as sodium borate, bleach activators, etc. Furthermore, in the present invention, when softness or flexibility is imparted to clothes, it is possible to incorporate a small amount of a cationic surfactant (for example, a quaternary ammonium salt), etc., and when an enhancement in the detergency against dirt is intended, it is possible to incorporate a small amount of an anionic surfactant (for example, a straight-chain alkylbenzenesulfonate, a sodium alkyl ether sulfate, a polyoxyethylene alkyl sulfate, an α-olefinsulfonate, an α-sulfo fatty acid ester or an alkanesulfonate) or the like.

The nonionic powdery detergent composition comprising the nonionic surfactant (a), the water-soluble chelating agent (b), the oil-absorbent carrier (c) and the alkali metal carbonate (d) and having a specified water-soluble alkali metal silicate content according to the present invention can be easily produced by gradually adding or spraying the nonionic surfactant (a) onto a mixture comprising the water-soluble chelating agent (b), the oil-absorbent carrier (c) and the alkali metal carbonate (d) as powdery components under stirring and further stirring the obtained mixture. As a result, particles consisting essentially of the nonionic powdery detergent composition according to the present invention and having an average particle diameter of 150 to 1000 μm, preferably 150 to 700 μm are obtained.

The nonionic powdery detergent composition comprising the nonionic surfactant (a), the water-soluble chelating agent (b), the oil-absorbent carrier (c), the alkali metal carbonate (d) and the polyethylene glycol (e) and having a specified water-soluble alkali metal silicate content according to the present invention can be easily produced by adding the polyethylene glycol (e) to a mixture comprising the water-soluble chelating agent (b), the oil-absorbent carrier (c) and the alkali metal carbonate (d) under stirring, gradually adding or spraying the nonionic surfactant (a) onto the obtained mixture under stirring and further stirring the resultant mixture. In this case, the polyethylene glycol (e) may be used also in the form of an aqueous solution thereof. As a result, particles consisting essentially of the nonionic powdery detergent composition according to the present invention and having an average particle diameter of 150 to 1000 μm, preferably 150 to 700 μm are obtained.

When the above-described detergent assistant and/or additive is incorporated into the nonionic powdery detergent composition according to the present invention, it is usually added to the above-described particles and mixed with the same.

Powder properties can be further improved by adding a water-insoluble powdery substance as a coating agent to the particles and mixing the obtained mixture to coat the particles with the water-insoluble powdery substance.

The water-insoluble powdery substance may be at least one member selected from among an amorphous silica, an amorphous aluminosilicate, a crystalline aluminosilicate, magnesium carbonate, calcium carbonate, magnesium silicate, calcium silicate and talc. Among them, a crystalline aluminosilicate, calcium carbonate, an amorphous silica and an amorphous aluminosilicate are particularly preferred. As the above-described water-insoluble powdery substances, those which have an average particle diameter in the range of from 0.5 to 50 μm, and preferably in the range of from 0.5 to 30 μm are used. The water-insoluble substance is incorporated into the composition in an amount of 0.1 to 20% by weight, preferably 0.1 to 10% by weight, and particularly preferably 0.5 to 5% by weight, based on the total weight of the composition.

The nonionic powdery detergent composition of the present invention thus obtained has a bulk density of about 0.6 to 1.2 g/ml, and preferably 0.7 to 0.9 g/mi. When the particle diameter of the nonionic powdery detergent composition of the present invention thus obtained is large (200 to 1000 μm, preferably 300 to 700 μm), a further improvement in the properties of the detergent powder during storage for a long period of time can be attained.

EXAMPLES

The present invention will now be described in more detail with reference to the following Examples, though it is not limited to these Examples only.

Example 1

The properties of the oil-absorbent carriers (c) according to the present invention and comparative oil-absorbent carriers used in the preparation of powdery detergent compositions are given in Tables 1 and 2.

TABLE 1

| Kind | pH of 5% dispersion | Oil absorbability (ml/100 g) | Silicon content as $SiO_2$ (wt. %) |
|---|---|---|---|
| Tokusil Al-1 ® (Tokuyama Soda Co., Ltd.) | 9.2 | 255 | 94 |
| Nipsil Na ® (Nippon Silica Industrial Co., Ltd.) | 10.2 | 245 | 93 |
| Tixolex 25 ® (Kofran Chemical) | 9.8 | 235 | 72 |
| Sipernat D 10 ® (DEGUSSA) | 10.3 | 240 | 98 |
| Florite RN ® (Tokuyama Soda Co., Ltd.) | 8.1 | 380 | 61 |
| Nipsil NS ® (Nippon Silica Industrial Co., Ltd.) | 6.1 | 250 | 93 |
| Carplex #80 ® (Shionogi Pharmaceutical Co., Ltd.) | 5.2 | 240 | 95 |
| Tokusil NR ® (Tokuyama Soda Co., Ltd.) | 5.8 | 280 | 94 |
| Tixosil 38 ® (Kofran Chemical) | 6.5 | 280 | 90 |

TABLE 2

| | Silicon content as $SiO_2$ (wt. %) | Oil absorbability (ml/100 g) | pH of 5% dispersion | Amt. of dissoln. in 100 ml of 2% aq. NaOH soln. (g) |
|---|---|---|---|---|
| Perlite (Dicalite, Perlite 4159 ®, DICALITEORIENT, Co., LTD.) | 72.7 | 165 | 7.8 | 0.01 |
| Na-Mordenite (HSZ-640NAA ®, Tosoh Corp.) | 87.5 | 110 | 10.7 | 0.12 |
| Florite RN ® (Tokuyama Soda Co., Ltd.) | 61 | 380 | 8.1 | 2.18 |
| Nipsil NS ® (Nippon Silica Industrial Co., Ltd.) | 93 | 250 | 6.1 | 2.01 |
| Carplex #80 ® ) Shionogi & Pharmaceutial Co., Ltd.) | 95 | 240 | 5.2 | 2.37 |
| Tokusil NR ® (Tokuyama Soda Co., Ltd.) | 94 | 280 | 5.8 | 2.35 |

TABLE 2-continued

| | Silicon content as $SiO_2$ (wt. %) | Oil absorbability (ml/100 g) | pH of 5% dispersion | Amt. of dissoln. in 100 ml of 2% aq. NaOH soln. (g) |
|---|---|---|---|---|
| Tixosil 38 ® (Kofran Chemical) | 90 | 280 | 6.8 | 2.51 |

A batch kneader (Bench Kneader. PNU-1 available from Irie Shokai Co., Ltd.) was charged with a water-soluble chelating agent, an oil-absorbent carrier and an alkali metal carbonate as components (b), (c) and (d) respectively and sodium silicate (only in Comparative Products 6 and 7) in the weight ratio specified in the following Tables 3 and 4 to prepare a mixture, and a melt of a polyethylene glycol having a weight-average molecular weight of 13000 as the component (e) was added thereto. Then, a liquid nonionic surfactant as the component (a) was gradually fed in the weight ratio specified in Tables 3 or 4 while maintaining the mixture at 40° C. under stirring to provide a homogeneous mixture having a particle diameter of 150 to 800 μm. Then, a water-insoluble powdery substance was added thereto, and the mixture thus obtained was stirred. The resulting mixture was shifted to extract or select particulate powders having a particle diameter of 200 to 600 μm, and other components (an additive and/or a detergent assistant) were further added thereto to provide a powdery detergent composition having a composition specified in Tables 3 or 4.

TABLE 3

| | | Product of the present invention | | | | | | |
|---|---|---|---|---|---|---|---|---|
| | Composition (pt. wt.) | 1 | 2 | 3 | 4 | 5 | 6 | 7 |
| component (a) | prim. synthetic alcohol ethoxylate ($C_{12-14}$, $EO\bar{p}$ = 10, m.p. 22° C.) | 25 | 25 | | 25 | 20 | 20 | 25 |
| | sec. alcohol ethoxylate ($C_{12-14}$, $EO\bar{p}$ = 7. m.p. −3° C.) | | | 25 | | | | |
| component (b) | sodium tripolyphosphate | 40 | 40 | 40 | | 35 | 35 | 40 |
| | sodium pyrophosphate | | | | 45 | | | |
| component (c) | Tokusil AL-1 ® | 7 | 7 | | 7 | | | |
| | Sipernat D10 ® | | | 8 | | | | |
| | Perlite ® | | | | | 15 | | |
| | Na-Mordenite ® | | | | | | 15 | |
| | Tixolex 25 ® | | | | | | | 8 |
| component (d) | sodium carbonate (av. particle diam.: 283 μm) | 15 | 15 | 15 | 10 | 16 | 16 | 15 |
| component (e) | polyethylene glycol (wt. av. mol. wt.: 13000) | 1.5 | 1.5 | 1.5 | 1.5 | 1.5 | 1.5 | 1.5 |
| Water-insol. powdery substance | zeolite 4A (av. particle diam.: 3 μm) | 3 | | 3 | 3 | 3 | 3 | 3 |
| | calcium carbonate (av. particle diam.: 4 μm) | | 3 | | | | | |
| Additive or detergent assistant | sodium polyacrylate (av. mol. wt.: 8000) | 2 | 2 | 2 | 2 | 2 | 2 | 2 |
| | fluorescent dye | 0.5 | 0.5 | 0.5 | 0.5 | 0.5 | 0.5 | 0.5 |
| | enzyme* | 1.0 | 1.0 | 1.0 | 1.0 | 1.0 | 1.0 | 1.0 |
| | water | 5 | 5 | 4 | 5 | 6 | 6 | 4 |
| Total | | 100 | 100 | 100 | 100 | 100 | 100 | 100 |

In the table, $EO\bar{p}$ represents the average number of moles of addition of ethylene oxide and the enzyme* is a mixture of 50 parts by weight of protease [Sabinase (manufactured by Novo Industry)] with 50 parts by weight of cellulose [Kao alkali cellulase (manufactured by Kao Corp.)] (the same shall apply hereinafter).

TABLE 4

| | | Product of the present invention | | | | | | |
|---|---|---|---|---|---|---|---|---|
| | Composition (pt. wt.) | 1 | 2 | 3 | 4 | 5 | 6 | 7 |
| component (a) | prim. synthetic alcohol ethoxylate $EO\bar{p}$ = 10, m.p. 22° C.) | 25 | 25 | 25 | 25 | 25 | 25 | 25 |
| component (b) | sodium tripolyphosphate | 40 | 40 | 40 | 40 | 40 | 40 | 40 |
| component (c) | Tokusil AL-1 ® | | | | | | 7 | |
| | Tixosil 38 ® | | 6 | | | | | 6 |
| | Nipsil NS ® | | | 7 | | | | |
| | Carplex #80 ® | | | | 7 | | | |
| | Florite RN ® | | | | | 5 | | |
| | Tokusil NR ® | 6 | | | | | | |
| component (d) | sodium carbonate (av. particle diam.: 283 μm) | 15 | 15 | 14 | 14 | 16 | 8 | 10 |
| component (e) | polyethylene glycol (wt. av. mol. wt.: 13000) | 1.5 | 1.5 | 1.5 | 1.5 | 1.5 | 1.5 | 1.5 |
| Water-insol. powdery | zeolite 4A (av. particle diam.: 3 μm) | 3 | 3 | 3 | 3 | 3 | | 3 |
| | calcium carbonate (av. particle diam.: 4 μm) | | | | | | 3 | |

TABLE 4-continued

| | Composition (pt. wt.) | Product of the present invention | | | | | | |
|---|---|---|---|---|---|---|---|---|
| | | 1 | 2 | 3 | 4 | 5 | 6 | 7 |
| substance | | | | | | | | |
| Additive or | JIS powder No. 1 sodium silicate | | | | | | 8 | 6 |
| detergent | sodium polyacrylate (av. mol. wt.: 8000) | 2 | 2 | 2 | 2 | 2 | 2 | 2 |
| assistant | fluorescent dye | 0.5 | 0.5 | 0.5 | 0.5 | 0.5 | 0.5 | 0.5 |
| | enzyme | 1.0 | 1.0 | 1.0 | 1.0 | 1.0 | 1.0 | 1.0 |
| | water | 6 | 6 | 6 | 6 | 6 | 4 | 5 |
| Total | 100 | 100 | 100 | 100 | 100 | 100 | 100 | |

The powdery detergent compositions thus obtained were subjected to a solubility test after a lapse of time by the following method.

[Evaluation method]

1. Test on Solubility after a Lapse of Time

A powdery detergent composition was placed in a Petri dish. 0.83 g of the powdery detergent composition was sampled after the Petri dish was allowed to stand at 30° C. and 70% RH for 3 days. 1 l of tap water at 10° C. was added to the sampled powdery detergent composition. The obtained mixture was stirred by means of a magnetic stirrer for 10 min and filtered through a 200-mesh wire gauze. Solid matter remaining on the wire gauze was dried, and the percentage filtration residue (%) was determined as follows. Results of the evaluation are given in Table 5.

$$\text{Percentage filtration residue (\%)} = \frac{\text{Amount of filtration residue}}{\text{Weight of sample}} \times 100$$

TABLE 5

| | | solubility after a lapse of time [percentage filtration residue (%)] |
|---|---|---|
| Product of | 1 | 0.3 |

TABLE 5-continued

| | | solubility after a lapse of time [percentage filtration residue (%)] |
|---|---|---|
| the present invention | 2 | 0.3 |
| | 3 | 0.4 |
| | 4 | 0.3 |
| | 5 | 0.2 |
| | 6 | 0.2 |
| | 7 | 0.2 |
| Comparative product | 1 | 3.4 |
| | 2 | 3.2 |
| | 3 | 3.3 |
| | 4 | 3.3 |
| | 5 | 3.0 |
| | 6 | 2.6 |
| | 7 | 3.9 |

Example 2

Powdery detergent compositions comprising components specified in Tables 6 and 7 were prepared in the same manner as that of the Example 1 and subjected to a solubility test after a lapse of time in the same manner as that of the Example 1.

The results are given in Table 8.

TABLE 6

| | Composition (pt. wt.) | Product of the present invention | | | | | | |
|---|---|---|---|---|---|---|---|---|
| | | 8 | 9 | 10 | 11 | 12 | 13 | 14 |
| component (a) | dodecyl alcohol ethoxylate ($EO\bar{p}$ = 8, m.p. 15° C.) | 15 | | 30 | | 12 | 15 | 15 |
| | prim. synthetic alcohol ethoxylate ($C_{12-14}$, $EO\bar{p}$ = 10, m.p. 22° C.) | | 15 | | 30 | | | |
| component (b) | trisodium citrate | 50 | 50 | 20 | 20 | 50 | 50 | 50 |
| component (c) | Nipsil NA ® | 7 | | 15 | 15 | 5 | | |
| | Tixolex 25 ® | | 7 | | | | | |
| | Tokusil AL-1 ® | | | | | | 7 | |
| | Sipernat D10 ® | | | | | | | 7 |
| component (d) | sodium carbonate | 22 | 22 | 25 | 25 | 14.5 | 18 | 20 |
| component (e) | polyethylene glycol (wt. av. mol. wt.: 13000) | 0.8 | 0.8 | 0.8 | 0.8 | 1 | 0.8 | 0.8 |
| Water-insol. | zeolite 4A (av. particle diam.: 3 μm) | 1.5 | 1.5 | | | 10 | 1.5 | 1.5 |
| powdery | calcium carbonate (av. particle diam.: 4 μm) | | | 4 | 4 | | | |
| substance | amorphous silica (av. particle diam.: 9 μm) | | | | | | 4 | |
| Additive or | JIS powder No. 1 sodium silicate | | | | | | | 2.0 |
| detergent | polymaleic acid/polyacrylic acid copolymer sodium salt | 1.2 | 1.2 | 1.2 | 1.2 | 3 | 1.2 | 1.2 |
| assistant | (av. mol. wt.: 8000) | | | | | | | |
| | fluorescent dye | 0.2 | 0.2 | 0.2 | 0.2 | 0.5 | 0.2 | 0.2 |
| | enzyme | 0.8 | 0.8 | 0.8 | 0.8 | 1 | 0.8 | 0.8 |
| | water | 1.5 | 1.5 | 3 | 3 | 3 | 1.5 | 1.5 |
| Total | | 100 | 100 | 100 | 100 | 100 | 100 | 100 |

TABLE 7

| | Composition (pt. wt.) | Comparative product 8 | 9 | 10 | 11 | 12 | 13 |
|---|---|---|---|---|---|---|---|
| component (a) | dodecyl alcohol ethoxylate (EOp̄ = 8, m.p. 15° C. | 15 | 15 | 15 | 15 | 15 | 19 |
| component (b) | trisodium citrate | 50 | 50 | 50 | 50 | 50 | 50 |
| component (c) | Nipsil NA ® | | | | | 7 | |
| | Nipsil NS ® | | 7 | | | | |
| | Carplex #80 ® | | | 7 | | | |
| | Tokusil NR ® | | | | 7 | | |
| | Florite RN ® | | | | | | 5 |
| | Tixosil 38 ® | 6 | | | | | |
| component (d) | sodium carbonate | 23 | 22 | 22 | 22 | 14 | 20 |
| component (e) | polyethylene glycol (wt. av. mol. wt.: 13000) | 0.8 | 0.8 | 0.8 | 0.8 | 0.8 | 0.8 |
| Water-insol. powdery substance | zeolite 4A (av. particle diam.: 3 μm) | 1.5 | 1.5 | 1.5 | 1.5 | 1.5 | 1.5 |
| Additive or detergent assistant | JIS power No. 1 sodium silicate | | | | | 8.0 | |
| | polymaleic acid/polyacrylic acid copolymer sodium salt (av. mol. wt.: 8000) | 1.2 | 1.2 | 1.2 | 1.2 | 1.2 | 1.2 |
| | fluorescent dye | 0.2 | 0.2 | 0.2 | 0.2 | 0.2 | 0.2 |
| | enzyme | 0.8 | 0.8 | 0.8 | 0.8 | 0.8 | |
| | water | 1.5 | 1.5 | 1.5 | 1.5 | 1.5 | 1.5 |
| Total | | 100 | 100 | 100 | 100 | 100 | 100 |

TABLE 8

| | | solubility after a lapse of time (percentage filtration residue (%)) |
|---|---|---|
| Product of the present invention | 8 | 0.2 |
| | 9 | 0.2 |
| | 10 | 0.3 |
| | 11 | 0.2 |
| | 12 | 0.3 |
| | 13 | 0.4 |
| | 14 | 0.4 |
| Comparative product | 8 | 2.9 |
| | 9 | 3.8 |
| | 10 | 3.8 |
| | 11 | 3.9 |
| | 12 | 4.7 |
| | 13 | 3.2 |

Example 3

The relationship between the addition of a water-insoluble powdery substance and the powder properties was examined by making use of the product 1 of the present invention prepared in Example 1 and a detergent composition prepared according to the same formulation as that of the product 1 of the present invention, except that no water-insoluble powdery substance was added. Regarding the powder properties, the fluidity and caking resistance were determined by the following methods. The results are given in Table 9.

2. Test on Fluidity of Powder:

The fluidity was measured with a stand and a funnel described in JIS K 3362 "Testing Methods for Synthetic Detergent" according to "Flow Rate" in "Flow Rate of Metal Powders" prescribed in ASTM: B213-48.

3. Caking Resistance Test:

(1) A box provided with no top sheathing and having a size of 10.2 cm in length×6.2 cm in width×4 cm in height was made of a filter paper (Toyo filter paper No. 2). Four corners of the box was stapled.

(2) 50 g of a sample was placed in this box, and an acrylic resin plate (15 g) and a lead plate (250 g) (total weight: 265 g) were put on the sample.

(3) Then, the box was allowed to stand in a thermohygrostat at 30° C. and 80% RH for 7 days to conduct a judgement on the caking resistance.

Judgment

The judgment of the caking resistance was conducted by determining the undersize by the following method.

(Undersize)

The sample after allowing to stand for 7 days under the above-described conditions was gently poured on a wire gauze (or sieve; mesh size : 5 mm×5 mm), and the weight of the powder passed through the wire gauze was measured to determine the undersize based on the tested whole sample.

$$\text{Undersize (\%)} = \frac{\text{Weight of powder passed through gauze (g)}}{\text{Weight of the whole sample (g)}} \times 100$$

TABLE 9

| Water-insol. powdery substance | Added | Not added |
|---|---|---|
| Fluidity (sec) | 8.0 | 11.1 |
| Caking resistance [Undersize (%)] | 100 | 79 |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A nonionic powdery detergent composition having a water-soluble alkali metal silicate content of less than 5% by weight based on the total weight of the composition, consisting essentially of;

(a) 12 to 35% by weight based on the total weight of the composition of a nonionic surfactant having a melting point of 40° C. or below;

(b) 5 to 60% by weight based on the total weight of the composition of a water-soluble chelating agent;

(c) 5 to 20% by weight based on the total weight of the composition of an amorphous aluminosilicate oil-absorbent carrier containing silicon in an amount of 30% by weight or more of $SiO_2$ as determined with no hydrate present, said amorphous aluminosilicate oil-absorbent carrier having an oil absorbability of 80 ml/100 g or more, and wherein said amorphous aluminosilicate oil-absorbent carrier as a 5% by weight dispersion has a pH value of 9 or greater; or wherein the amount of dissolution of said amorphous aluminosilicate oil-absorbent carrier in 100 ml of a 2% by weight aqueous NaOH solution is 0.5 g or less; and (d) 2 to 40% by weight based on the total weight of the composition of an alkali metal carbonate;

obtained by the process comprising:

mixing the powders comprising the water-soluble chelating agent (b), the oil-absorbent carrier (c) and the alkali metal carbonate (d);

gradually adding or spraying the non-ionic surfactant (a) onto said obtained mixture under stirring; and granulating the mixture.

2. The nonionic powdery detergent composition according to claim 1, wherein the nonionic surfactant (a) is a polyoxyethylene alkyl ether produced by adding ethylene oxide to an alcohol having 10 to 20 carbon atoms in such a manner that the average number of moles of addition of ethylene oxide is 5 to 15.

3. The nonionic powdery detergent composition according to claim 1, wherein the water-soluble chelating agent (b) is at least one member selected from the group consisting of pyrophosphates, hexametaphosphates and tripolyphosphates.

4. The nonionic powdery detergent composition according to claim 1, wherein the water-soluble chelating agent (b) is citric acid or its salt.

5. The nonionic powder detergent composition according to claim 1, wherein the oil-absorbent carrier (c) is one satisfying both requirements that said oil-absorbent carrier as a 5% by weight dispersion has a pH value of 9 greater and that the amount of dissolution of said oil-absorbent carrier in 100 ml of a 2% by weight aqueous NaOH solution is 0.5 g or less.

6. The nonionic powdery detergent composition according to claim 1, wherein the alkali metal carbonate (d) is sodium carbonate.

7. The nonionic powdery detergent composition according to claim 1, which has a bulk density of 0.6 to 1.2 g/cm$^3$ and an average particle diameter of 200 to 1000 μm.

8. A nonionic powdery detergent composition having a water-soluble alkali metal silicate content of less than 5% by weight based on the total weight of the composition consisting essentially of;

(a) 12 to 35% by weight based on the total weight of the composition of a nonionic surfactant having a melting point of 40° C. or below;

(b) 5 to 60% by weight based on the total weight of the composition of a water-soluble chelating agent;

(c) 5 to 20% by weight based on the total weight of the composition of an oil-absorbent carrier containing silicon in an amount of 30% by weight or more of $SiO_2$ as determined with no hydrate present, said oil-absorbent carrier having an oil absorbability of 80 ml/100 g or more, and wherein said oil-absorbent carrier as a 5% by weight dispersion has a pH value of 9 or greater; or wherein the amount of dissolution of said oil-absorbent carrier in 100 ml of a 2% by weight aqueous NaOH solution is 0.5 g or less;

(d) 2 to 40% by weight based on the total weight of the composition of an alkali metal carbonate; and (e) 1 to 5% by weight based on the total weight of the composition of a polyethylene glycol having a weight average molecular weight of 4,000 to 20,000;

obtained by the process comprising:

mixing components comprising the water-soluble chelating agent (b), the oil-absorbent carrier (c), the alkali metal carbonate (d) and the polyethylene glycol (e);

gradually adding or spraying the nonionic surfactant (a) onto said obtained mixture, under stirring; and granulating the mixture.

9. The nonionic powdery detergent composition according to claim 8, wherein the water-soluble chelating agent (b) is citric acid or its salt.

10. The nonionic powdery detergent composition according to claim 8, wherein the oil-absorbent carrier (c) is an amorphous silica.

11. The nonionic powder detergent composition according to claim 8, wherein the oil-absorbent carrier (c) is an amorphous aluminosilicate.

12. The nonionic powder detergent composition according to claim 8, wherein the oil-absorbent carrier (c) is one satisfying both requirements that said oil-absorbent carrier as a 5% by weight dispersion has a pH value of 9 greater and that the amount of dissolution of said oil-absorbent carrier in 100 ml of a 2% by weight aqueous NaOH solution is 0.5 g or less.

13. The nonionic powdery detergent composition according to claim 8, which has a bulk density of 0.6 to 1.2 g/cm$^3$ and an average particle diameter of 200 to 1000 μm.

14. A process for producing a nonionic powdery detergent composition having a water-soluble alkali metal silicate content of less than 5% by weight based on the total weight of the composition consisting essentially of;

gradually adding or spraying under stirring (a) 12 to 35% by weight based on the total weight of the composition of a nonionic surfactant having a melting point of 40° C. or below onto a mixture comprising (b) 5 to 60% by weight based on the total weight of the composition of a water-soluble chelating agent; (c) 5 to 20% by weight based on the total weight of the composition of an oil-absorbent carrier containing silicon in an amount of 30% by weight or more of $SiO_2$ as determined with no hydrate present, said oil-absorbent carrier having an oil absorbability of 80 ml/100 g or more, and wherein said oil-absorbent carrier as a 5% by weight dispersion has a pH value of 9 or greater; or wherein the amount of dissolution of said oil-absorbent carrier in 100 ml of a 2% by weight aqueous NaOH solution is 0.5 g or less; and (d) 2 to 40% by weight based on the total weight of the composition of an alkali metal carbonate;

to produce particles having an average particle diameter of 150 to 1000 μm.

15. The process according to claim 14, which further comprises mixing said produced particles with at least one detergent assistant or an additive selected from the group consisting of an inorganic electrolyte, an antiredeposition agent, an enzyme, an antioxidant, a fluorescent dye, a blueing agent, a perfume, a bleaching agent, a stabilizer for peroxide, a cationic surfactant and an anionic surfactant.

16. A process for producing a nonionic powdery detergent composition having a water-soluble alkali metal silicate content of less than 5% by weight based on the total weight of the composition which consisting essentially of;

adding under stirring (e) 1 to 5% by weight based on the total weight of the composition of a polyethylene glycol having a weight average molecular weight of 4,000 to 20,000 to a mixture comprising (b) 5 to 60% by weight based on the total weight of the composition of a water-soluble chelating agent; (c) 5 to 20% by weight based on the total weight of the composition of an oil-absorbent carrier containing silicon in an amount of 30% by weight or more of $SiO_2$ as determined with no hydrate present, said oil-absorbent carrier having an oil absorbability of 80 ml/100 g or more, and wherein said oil-absorbent carrier as a 5% by weight dispersion has a pH value of 9 or greater; or wherein the amount of dissolution of said oil-absorbent carrier in 100 ml of a 2% by weight aqueous NaOH solution is 0.5 g or less; and (d) 2 to 40% by weight based on the total weight of the composition of an alkali metal carbonate; and gradually adding or spraying under stirring (a) 12 to 35% by weight based on the total weight of the composition of a nonionic surfactant having a melting point of 40° C. or below onto the obtained mixture;

to produce particles having an average particle diameter of 150 to 1000 μm.

17. The process according to claim 16, which further comprises mixing said produced particles with at least one detergent assistant or additive selected from the group consisting of an inorganic electrolyte, an antiredeposition agent, an enzyme, an antioxidant, a fluorescent dye, a blueing agent, a perfume, a bleaching agent, a stabilizer for peroxide, a cationic surfactant and an anionic surfactant.

18. A nonionic powdery detergent composition having a water-soluble alkali metal silicate content of less than 5% by weight based on the total weight of the composition, consisting essentially of;

(a) 12 to 35% by weight based on the total weight of the composition of a nonionic surfactant having a melting point of 40° C. or below;

(b) 5 to 60% by weight based on the total weight of the composition of a water-soluble chelating agent;

(c) 5 to 20% by weight based on the total weight of the composition of an amorphous aluminosilicate oil-absorbent carrier containing silicon in an amount of 30% by weight or more of $SiO_2$ as determined with no hydrate present, said amorphous aluminosilicate oil-absorbent carrier having the following formula $$Na_2O.Al_2O_3.m(SiO_2).c(H_2O) \quad (2)$$

wherein m is 1.8 to 3.2 and c is 1 to 6; and (d) 2 to 40% by weight based on the total weight of the composition of an alkali metal carbonate;

obtained by the process comprising:

mixing the powders comprising the water-soluble chelating agent (b), the oil-absorbent carrier (c) and the alkali metal carbonate (d);

gradually adding or spraying the non-ionic surfactant (a) onto said obtained mixture under stirring; and granulating the mixture.

* * * * *